US006216602B1

(12) United States Patent
Fukuzaki et al.

(10) Patent No.: US 6,216,602 B1
(45) Date of Patent: Apr. 17, 2001

(54) BALANCE CONTROL MECHANISM FOR OVERHEAD TRAVELING CARRIER

(75) Inventors: Daisuke Fukuzaki, Yao; Yoshikazu Nakano, Ibaraki, both of (JP)

(73) Assignee: Tsubakimoto Chain Co., Osaka (JP)

( * ) Notice: Subject to any disclaimer, the term of this patent is extended or adjusted under 35 U.S.C. 154(b) by 0 days.

(21) Appl. No.: 09/387,957

(22) Filed: Sep. 1, 1999

(30) Foreign Application Priority Data

Oct. 9, 1998 (JP) ..... 10-288105

(51) Int. Cl.[7] ..... B61B 13/04

(52) U.S. Cl. ..... 105/148; 105/150; 105/152; 105/154; 105/155; 105/199.2; 104/89; 104/93; 701/124; 198/680; 280/755

(58) Field of Search ..... 105/148, 149, 105/150, 152, 154, 155, 199.2; 104/89, 93, 94, 95; 701/124; 280/755; 198/680, 802, 474.1

(56) References Cited

U.S. PATENT DOCUMENTS 3,106,171 * 10/1963 Julien ..... 104/94
4,475,462 * 10/1984 Tsumaki et al. ..... 105/149
5,197,390 * 3/1993 Richardson ..... 105/149.1
5,921,185 * 7/1999 Hoyon et al. ..... 105/4.1

FOREIGN PATENT DOCUMENTS

1236533 * 6/1960 (FR) .
1409271 * 10/1975 (GB) ..... 105/148

* cited by examiner

*Primary Examiner*—S. Joseph Morano
*Assistant Examiner*—Frantz F. Jules
(74) *Attorney, Agent, or Firm*—Dann, Dorfman, Herrell and Skillman; Henry H. Skillman

(57) ABSTRACT

A balance control mechanism for an overhead traveling carrier includes a movable section disposed on a carrier body at a position below the fulcrum of a traveling wheel of the carrier such that the movable section can be moved laterally of the carrier body to thereby displace the center of gravity of the movable section laterally of the carrier body, a gravity center moving unit for moving the center of gravity of the movable section with respect to the carrier body, and a balance control unit for calculating a balancing position at which the center of gravity of the movable section is to be placed so that the moment of a centrifugal force turning around the fulcrum with an axis lying in a direction of travel of the carrier and applied to the carrier in its entirety upon travel of the carrier over a curved portion of the rail is counterbalanced by the moment of gravity, and then controlling the gravity center moving unit to cause the center of gravity of the movable section to be moved to the balancing position. This arrangement enables travel of the overhead traveling carrier along a curved portion of an overhead rail at a high speed without being laterally swung.

4 Claims, 2 Drawing Sheets

BALANCE CONTROL MECHANISM FOR OVERHEAD TRAVELING CARRIER

BACKGROUND OF THE INVENTION

1. Field of the Invention

The present invention relates to a balance control mechanism for restraining the lateral swinging of a carrier body of an overhead traveling carrier upon travel of the latter on a curved portion of an overhead rail.

2. Description of the Related Art

In a factory or the like, an overhead traveling carrier is used to transport an article from one place to another by moving it on wheels along an overhead rail. When it travels along a curved portion of the rail, the carrier is liable to be swung laterally due to a carrier body thereof or an article loaded on the body, leaned by exerted centrifugal force.

For preventing such lateral swinging of a carrier body, an arrangement is proposed in Japanese Utility Model Post-Exam Publication No. HEI 8-8938. The proposed arrangement comprises auxiliary overhead rails provided on both sides of a curved portion of an overhead rail, and auxiliary traveling rolls disposed on the right and left sides of an overhead traveling carrier for being held against the auxiliary overhead rails to thereby prevent the lateral swinging of the carrier body.

In the proposed arrangement, however, a centrifugal force exerted to the carrier body upon passage of the latter over a curved portion of the overhead rail is killed by the auxiliary overhead rails via the auxiliary traveling rolls. Thus, when the overhead rail has a small radius of curvature, large centrifugal force is exerted to the carrier body, thereby requiring the carrier body and auxiliary overhead rails to have increased rigidity.

For increasing the rigidity of the carrier body and auxiliary overhead rails, they need to be increased in weight and size, thereby increasing the cost of production. Otherwise, the overhead traveling carrier must be operated to travel along the curved rail portion at a low speed, thereby making the cycle of article transport prolonged.

SUMMARY OF THE INVENTION

The present invention has been attained in a course of research to overcome the foregoing conventional problems. It is accordingly an object of the present invention to provide an improved balance control mechanism for an overhead traveling carrier, which, without using auxiliary overhead rails and traveling rolls as provided in the conventional arrangement, enables travel of the overhead traveling carrier along a curved portion of an overhead rail at a high speed without causing lateral swinging of the carrier.

According to the present invention, there is provided a balance control mechanism for an overhead traveling carrier having a carrier body suspended from an overhead rail by means of a traveling wheel and being capable of traveling along the overhead rail, which balance control mechanism comprises: a movable section disposed on the carrier body at a position below the fulcrum of the traveling wheel on the overhead rail such that the movable section can be moved laterally with respect to the carrier body to thereby displace the center of gravity of the movable section laterally of the carrier body; gravity center moving means for moving the center of gravity of the movable section with respect to the carrier body; and balance control means for calculating a balancing position at which the center of gravity of the movable section is to be placed so that the moment of a centrifugal force turning around the fulcrum with an axis lying in a direction of travel of the carrier and applied to the carrier in its entirety upon travel of the carrier over a curved portion of the rail is counterbalanced by the moment of gravity, and then controlling the gravity center moving means to cause the center of gravity of the movable section to be moved to the balancing position.

With this arrangement, since the centrifugal force moment which causes the lateral swinging of the carrier body upon travel of the carrier along the curved rail portion is counterbalanced by the gravity moment produced by shifting the center of gravity of the movable section, it becomes possible for the overhead traveling carrier to travel over the rail at a high speed.

In a preferred form, the balance control means calculates the balancing position by using data representing a radius of curvature of said rail, which data is read, by means of data reading means disposed on the carrier, from a data strip attached to the rail. Since the auxiliary overhead rails for bearing the centrifugal force applied to the carrier body on the curved rail portion, as required in the conventional arrangement, are no longer required, it becomes possible to significantly reduce the cost of production of overhead traveling carriers.

Desirably, the gravity center moving means comprises a toothed drive pulley disposed within the carrier body at a lower part thereof, a toothed driven pulley disposed within the carrier body at a lower part thereof oppositely from the toothed drive pulley, a toothed belt trained around the toothed drive pulley and the toothed driven pulley, and a stepping motor disposed within the carrier body for driving the toothed drive pulley.

The above and other objects, advantages and features of the present invention will become apparent to those versed in the art upon making reference to the detailed description and accompanying sheets of drawings in which a preferred structural embodiment of the present invention is shown by way of illustrative example.

DETAILED DESCRIPTION OF THE PREFERRED EMBODIMENT

The following description is merely exemplary in nature and is in no way intended to limit the invention or its application or uses.

Figure 1:
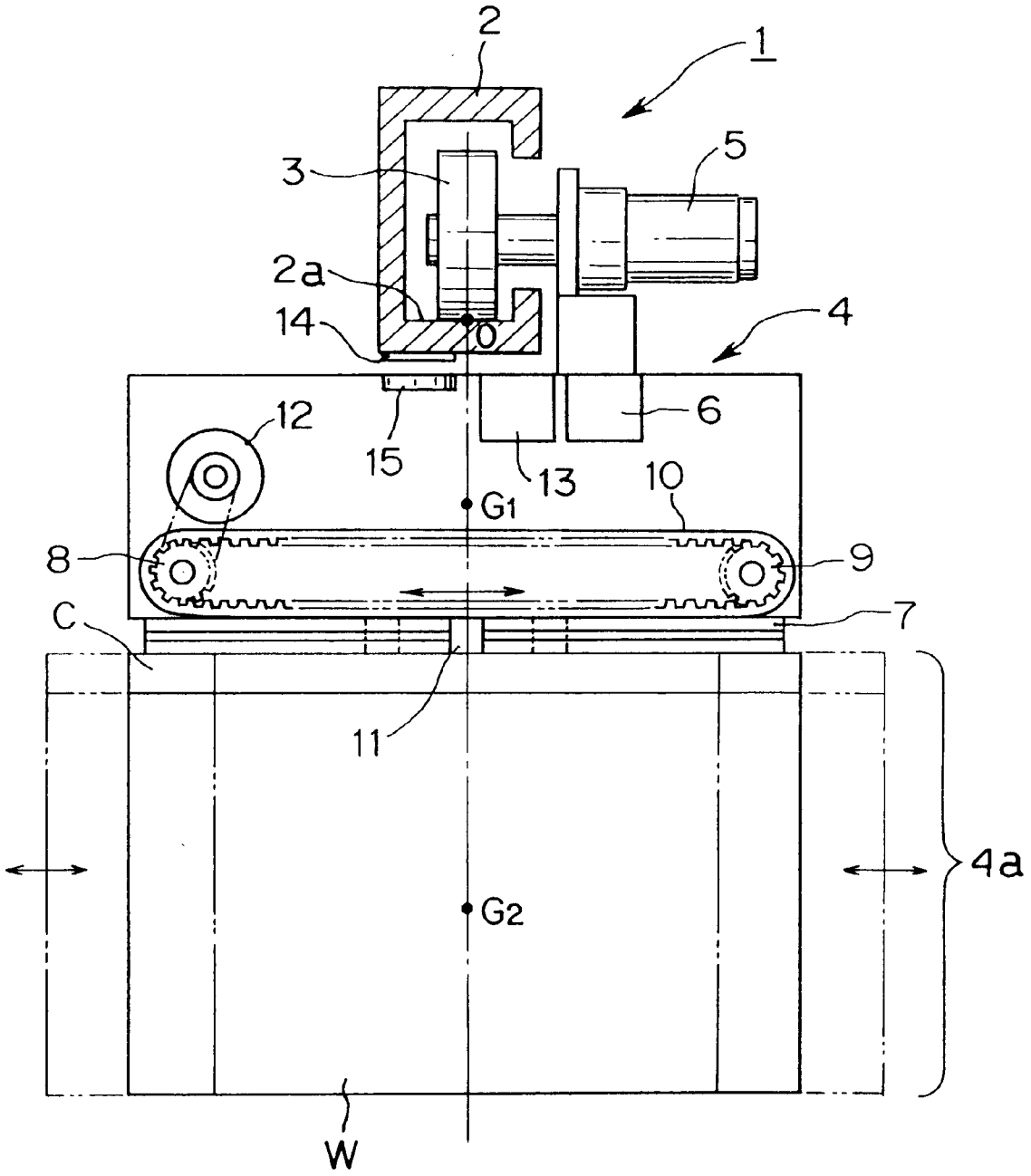
FIG. 1 is a schematic view illustrating the arrangement of an overhead traveling carrier employing a balance control mechanism according to the present invention.

Reference is initially made to FIG. 1 which schematically illustrates the arrangement of an overhead traveling carrier employing a balance control mechanism according to the present invention. The overhead traveling carrier 1 comprises a carrier body 4 and an overhead rail 2 to be fixed to a building structure of a factory or the like (not shown). The carrier 1 is suspended from the rail 2 by means of traveling wheels 3 (only one shown) thereof disposed to roll on a horizontal surface or track 2*a* of the rail 2.

The traveling wheels 3 are disposed in spaced relation to each other along the length of the overhead rail 2 positioned upwardly of the carrier body 4. One of the wheels 3 is driven by an electric motor 5 to thereby effect the travel of the carrier 1.

The motor 5 is controlled by a program stored in a travel control means or unit 6 provided in the carrier body 4, and command data fed to the travel control unit 6 from outside the carrier 1.

A movable section 4*a* is provided below the carrier body 4. Between the movable section 4*a* and an underside surface of the carrier body 4, there is disposed a pair of parallel linear guide mechanisms 7 spaced from each other in a direction of travel of the carrier 1 and extending in a direction perpendicular to the carrier travel direction. The movable section 4*a* is supported by the guide mechanisms 7 such that it can slide laterally of the carrier body 4.

Inside the carrier body 4, a toothed drive pulley 8 and a toothed driven pulley 9 are rotatably disposed at lower left and right positions. A toothed belt 10 is trained around the drive and driven pulleys 8, 9.

The toothed belt 10 is connected with an upper surface of the movable section 4*a* through a connector member 11. A balance controlling stepper motor 12 is also provided in the carrier body 4 for serving as a gravity center displacing means. By clockwise and counterclockwise rotation of the motor 12, the movable section 4*a* is moved transversely of the carrier body 4 (in a right-and-left direction relative to the body).

The stepping motor 12 is controlled of its rotation by a pulse signal outputted from a balance control means or unit 13 disposed in the carrier body 4.

In the present embodiment, the gravity center displacing means or unit is constituted jointly by the toothed drive pulley 8, toothed driven pulley 9, toothed belt 10, and the stepping motor 12.

The movable section 4*a* comprises a retainer member C and a workpiece W of given form or kind to be carried, which is retained by the retainer member C. The retainer member C has a workpiece sensor (not shown) for detecting the presence of a workpiece W.

On an underside surface of the overhead rail 2, there is provided a data strip 14 containing data such as a radius of curvature of the rail 2 represented by bar codes. The data strip 14 is disposed on the rail 2 at positions shortly before such transitional portions where a linear portion turns into a curved portion, where a curved portion turns into a linear portion, and where a radius of curvature varies at the midst of the curved rail portion. Upon travel of the overhead traveling carrier 1 along the overhead rail 2, the radius-of-curvature data held by the data strip 14 is read by a data reading means or unit 15 which comprises a bar code reader disposed on an opposed upper surface of the carrier body 4. The read information is supplied to the balance control unit 13.

As can be readily appreciated by skilled artisans, the data strip 14 and data reading unit 15 may take other forms than those described above. For example, the data strip may be one containing magnetically recorded data while the data reading unit may be one which magnetically reads such data.

Discussion will be made next as to the operational principle of the balance control mechanism of the present invention with reference to FIGS. 2A to 2C.

Figure 2A:
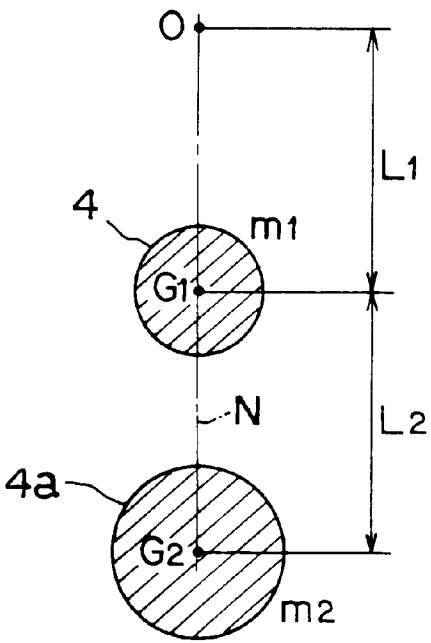
FIG. 2A is a schematic view illustrating a condition in which the overhead traveling carrier is placed when it travels over a linear portion of an overhead rail or stands still on the linear rail portion.

When the overhead traveling carrier 1 runs along a linear portion of the overhead rail 2 or stands still on the rail 2, the carrier body 4 and movable section 4*a* have their respective centers of gravity $G_1$ and $G_2$ as schematically shown in FIG. 2A. The masses of the carrier body 4 and movable section 4*a* are represented by $m_1$ and $m_2$, respectively. The center of gravity $G_1$ of the carrier body 4 is positioned on a perpendicular N, passing over the fulcrum O of the traveling wheel 3 on the overhead rail 2, at its position downwardly spaced a distance $L_1$ from the fulcrum O. The center of gravity $G_2$ of the movable section 4*a* is also positioned on the perpendicular N but downwardly spaced an additional distance $L_2$. In this state, the sole external force applied to the overhead traveling carrier 1 is gravity that acts downwardly on the perpendicular N passing over the fulcrum O. Since no moment thus arises around the fulcrum O the overhead traveling carrier 1 is in no way inclined or swung.

Figure 2B:
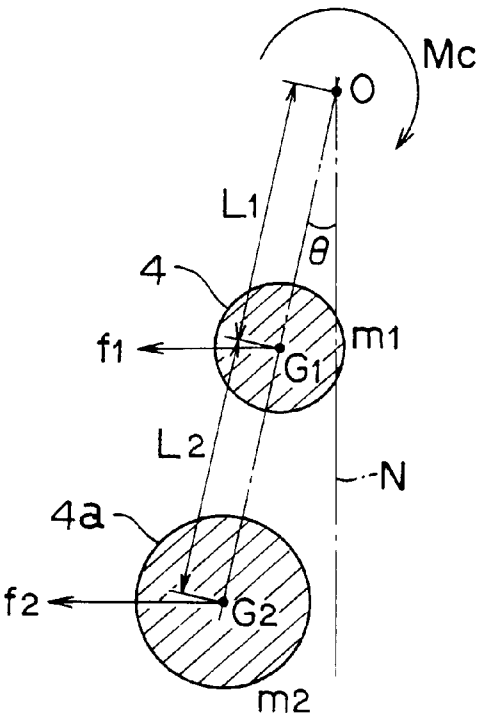
FIG. 2B is a schematic view illustrating a condition in which the overhead traveling carrier is placed when it travels over a curved portion of the overhead rail without the operation of the balance control mechanism according to the present invention.

When the overhead traveling carrier 1 runs over a curved portion of the overhead rail 2 with the positional relations between the carrier body 4 and the movable section 4*a* kept as shown in FIG. 2A but without operating the balance control mechanism according to the present invention, the carrier body 4 and the movable section 4*a* will be swung as shown in FIG. 2B. At this time, centrifugal forces $f_1$ and $f_2$ are applied horizontally to the respective centers of gravity G1 and G2 of the carrier body 4 and movable section 4*a* to thereby cause a moment Mc to arise around the fulcrum O. As a result, the carrier body 4 and movable section 4*a* connected thereto are inclined by an angle θ relative to the perpendicular N passing over the fulcrum O.

The angle of inclination θ becomes larger with an increase in the running speed of the overhead traveling carrier 1. When the carrier 1, inclined by the angle θ as a result of running over the curved rail portion, enters a linear rail portion, the centrifugal forces $f_1$, $f_2$ die down with the result that the carrier body 4 and the movable section 4*a* are laterally swung about the fulcrum O like a pendulum.

Figure 2C:
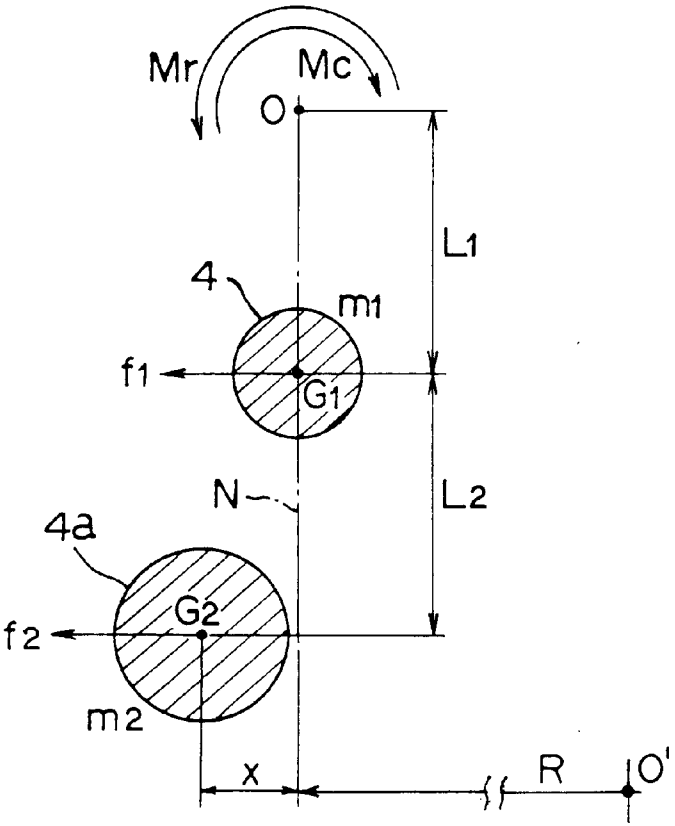
FIG. 2C is a schematic view illustrating how the overhead traveling carrier is balanced by the inventive balance control mechanism when it travels over the curved rail portion.

In contrast, when the overhead traveling carrier 1 runs over the curved rail portion with the inventive balance control mechanism operated, the carrier 1 is balanced as illustrated in FIG. 2C. As shown in this figure, the center of gravity $G_1$ of the carrier body 4 is placed on the perpendicular N passing over the fulcrum O, whilst the center of gravity $G_2$ of the movable section 4*a* is displaced a distance X from the perpendicular N in a horizontal direction away from a curvature center O' of the rail 2.

Where the radius of curvature of the rail 2 is R and the running speed of the carrier 1 is V, the centrifugal force $f_1$ applied to the center of gravity $G_1$ of the carrier body 4 having a mass of $m_1$ is obtained by the equation: $f_1=m_1V^2/R$. Similarly, the centrifugal force $f_2$ applied to the center of gravity $G_2$ of the movable section 4*a* having a mass of $m_2$ is obtained by the equation: $f_2=m_2V^2/R$. In this instance, the radius of curvature R of the rail should be sufficiently large as compared to the distance X. The moment Mc generated at this time by the centrifugal forces $f_1$ and $f_2$ applied to the carrier 1 through around the fulcrum O is obtained by the equation:

$$Mc=f_1L_1+f_2(L_1+L_2).$$

By horizontally displacing the center of gravity $G_2$ of the movable section 4*a* by the distance X from the perpendicular N passing over the fulcrum O, a moment Mr, resulted from the weight $m_2g$ of the movable section 4*a* and turning around the fulcrum O in a direction opposite from that of the moment Mc, is applied to the carrier 1. Character g used herein represents the acceleration of gravity. Then, the equation $Mr=Xm_2g$ is established.

Consequently, by setting the value of X to satisfy Mc=Mr, it becomes possible to remove the moment arising around the fulcrum O and applied to the carrier 1 to thereby prevent the lateral swinging of the carrier 1 that occurs upon travel of the carrier 1 on the curved rail portion.

The distance X can be obtained through the equation:

$$X=(L_2+L_1(m_1+m_2)/m_2)V^2/(Rg).$$

Values of m1 and L1 are automatically determined by the arrangements of the carrier 1 and the carrier body 4. The position of the center of gravity $G_2$ and the mass $m_2$ of the movable section 4*a* can also be known in advance as far as the workpiece W to be transported is specified. The running velocity of the carrier 1 is preset or otherwise can be found out easily from the rotation of the wheel 3.

Shortly before the carrier 1 enters the curved rail portion, the data reading unit 15 reads from the data strip 14 on the rail 2, data representing the radius of curvature R of the rail 2. Based on the radius of curvature value read by the data reading unit 15, the balance control unit 13 calculates the distance X and controls the stepping motor 12 so that the movable section 4*a* is moved to establish the positional relation as shown in FIG. 2C.

The balance control unit 13 pre-stores in plural possible values the mass $m_2$ and the vertical gravitational center position $L_2$ of the movable section 4*a*. The distance X comes out in different values when the retainer member C retains the workpiece W and when it does not. The distance X also comes out in different values as the workpiece W is of different kind.

Detection of the kind of the carried workpiece W may be effected by means of the workpiece sensor added with such detection capability. For example, the sensor may be designed to optically read an identification code attached to the workpiece W. As for the workpiece W having a fixed center of gravity, the retainer member C may be provided with a load sensor for measuring the weight of the workpiece W to thereby identify the kind of the workpiece W.

Although not shown, an additional data strip, similar to the data strip 14, is disposed on the rail 2 at a position shortly before the end of the curved rail portion, for moving the position of the movable section 4*a* relative to the carrier body 4. Upon travel of the carrier 1 past the additional data strip, the balance control unit 13 controls the stepping motor 12 to move the movable section 4*a* back into the position of FIG. 2A.

In operation, when the carrier 1 stands still on the rail 2 or travels along the linear rail portion, the center of gravity of the carrier 1 is positioned vertically downwardly of the fulcrum O. At this time, the carrier 1 is suspended immediately below the rail 2.

When the carrier 1 travels along the curved rail portion, a centrifugal force is applied to the carrier 1 in its entirety. The centrifugal force causes moment to arise turning around the fulcrum O, with an axis lying in a direction of travel of the carrier 1.

Shortly before the carrier 1 enters into the curved rail portion, the balance control unit 13 calculates the balancing position at which the center of gravity of the movable section 4*a* is to be placed so that the moment resulted from the centrifugal force turning around the fulcrum O and applied to the carrier 1 is counterbalanced by the gravity-generated moment. Then, it controls the gravity center moving unit so that the center of gravity of the movable section 4*a* is moved to the balancing position.

As a result, the moment produced by the centrifugal force turning around the fulcrum O is nullified by the moment of gravity turning around the fulcrum O, thereby enabling the carrier 1 to travel along the curved rail portion without being swung laterally.

Further, to calculate the balancing position, the balance control unit 13 reads the required data representing the radius of curvature of the rail 2 from the data strip 14 attached to the rail 2 by means of the data reading unit 15 provided on the carrier 1.

Based on the radius-of-curvature data of the rail 2 read by the data reading unit 15, the speed of travel of the carrier 1, and the respective weights and gravitational center positions of the carrier body 4 and movable section 4*a*, the balance control unit 13 calculates the moment arising due to the centrifugal force turning around the fulcrum O, with an axis lying in a direction of travel of the carrier 1. Then, the balance control unit 13 calculates the desired balancing position at which the center of gravity of the movable section 4*a* is to be placed so that the moment is counterbalanced by the moment of gravity.

In the embodiment described above, the movable section 4*a* is composed of the retainer member C and the workpiece W of given kind or form retained by the retainer member C. Alternatively, the movable section may be provided merely as a balance weight for varying the center of gravity of the overhead traveling carrier in a right-and-left direction, whilst the retainer member C may be designed not to move in a lateral (right-and-left) direction.

As can be appreciated by those skilled in the art, the means for moving the center of gravity of the movable section 4*a* relative to the carrier body 4 are not be limited to the described arrangement employing the toothed belt 9. For example, a chain may be employed in place of the toothed belt. A rack and pinion mechanism or a cylinder mechanism can also take the place of the toothed belt.

In the described embodiment, the movable section 4*a* is moved linearly with respect to the carrier body 4 by means of the linear guide mechanism 7. Alternatively, the movable section 4*a* and the carrier body 4 may be connected together via a pair of parallel links so that the center of gravity of the movable section 4*a* can be shifted in a right-and-left direction.

As described above, the balance control unit 13 calculates the balancing position for the center of gravity $G_2$ of the movable section 4*a* by using the radius-of-curvature data read from the data strip 14 attached to the rail 2. However, an alternative arrangement may be employed in which the data relating to the radius of curvature of the rail 2 is pre-stored in the balance control unit 13 in correspondence with the positions of travel of the carrier 1 so that the travel positions of the carrier 1 can be detected to thereby calculate the balancing position.

In the described embodiment, the travel control unit 6 for controlling the travel of the carrier 1 is provided independently from the balance control unit 13 for controlling the movement of the movable section 4*a*. However, the travel control unit 6 and the balance control unit 13 may be provided in a single control unit.

As explained above, the centrifugal force moment which causes the lateral swinging of the carrier body 4 upon travel of the carrier 1 along the curved rail portion is nullified by the gravity moment produced by shifting the center of gravity of the movable section 4*a*. As a result, the overhead traveling carrier 1 becomes capable of traveling at a high speed and may conveniently be used for transporting semiconductor wafers.

Further, since the auxiliary overhead rails for bearing the centrifugal force applied to the carrier body on the curved rail portion, as required in the conventional arrangement, are no longer required, it becomes possible to significantly reduce the cost of production of overhead traveling carriers.

In addition, by virtue of the arrangement in which the data representing by way of bar codes the radius of curvature of the overhead rail are read in real time from the data strip 14 to cause the balance control unit 13 to calculate the balancing position, it becomes unnecessary for the balance control unit 13 to pre-store the radius-of-curvature data corresponding to the positions of travel of the carrier 1 and to monitor such travel positions, whereby the balance control mechanism can be simplified in arrangement and improved in reliability.

Obviously, various minor changes and modifications of the present invention are possible in the light of the above teaching. It is therefore to be understood that within the scope of the appended claims, the present invention may be practiced otherwise than as specifically described.

What is claimed is:

1. A balance control mechanism for a conveyor assembly having an overhead traveling carrier with a carrier body, an overhead rail having a configuration including curved portions each with a radius of curvature, and a traveling wheel on said body capable of traveling along the overhead rail, said wheel having a fulcrum with an axis lying in a direction of travel of said carrier about which said body is free to swing transversely to said rail, said balance control mechanism comprising:

a movable section adapted to be disposed on said carrier body at a position below said fulcrum such that said movable section can be moved laterally with respect to said carrier body to thereby displace the center of gravity of said movable section laterally of said carrier body;

gravity center moving means for moving the center of gravity of said movable section with respect to said carrier body; and balance control means operable to receive data identifying the configuration of the rail and the speed of travel of said wheel for the current position of the wheel in its travel along the rail, for calculating a balancing position at which the center of gravity of said movable section is to be placed so that the moment of a centrifugal force turning around said fulcrum and applied to said carrier upon travel of said carrier in its current position is counterbalanced by the moment of gravity, and then controlling said gravity center moving means to cause the center of gravity of said movable section to be moved to said balancing position.

2. A balance control mechanism according to claim 1, wherein said balance control means calculates said balancing position at which the center of gravity of said movable section is to be placed, by using data representing a radius of curvature of said rail read from the data strip.

3. A balance control mechanism according to claim 2 in which the assembly has a toothed driven pulley disposed within said carrier body at a lower part of said carrier body wherein said gravity center moving means comprises a toothed drive pulley adapted to be disposed within said carrier body at a lower part thereof oppositely from said toothed driven pulley, a toothed belt adapted to be trained around said toothed drive pulley and said toothed driven pulley, and a stepping motor adapted to be disposed within said carrier body for driving said toothed drive pulley.

4. A balance control mechanism according to claim 1 in which the assembly has a toothed driven pulley disposed within said carrier body at a lower part of said carrier body wherein said gravity center moving means comprises a toothed drive pulley disposed within said carrier body at a lower part thereof oppositely from said toothed driven pulley, a toothed belt adapted to be trained around said toothed drive pulley and said toothed driven pulley, and a stepping motor adapted to be disposed within said carrier body for driving said toothed drive pulley.

* * * * *